US005988445A

United States Patent [19]

Massena

[11] Patent Number: 5,988,445

[45] Date of Patent: Nov. 23, 1999

[54] GLUE GUN SYSTEM WITH REMOVABLE CARTRIDGES

[75] Inventor: Leonard Massena, Dallas, Tex.

[73] Assignee: Uniplast, Inc., Arlington, Tex.

[21] Appl. No.: 09/114,500

[22] Filed: Jul. 13, 1998

Related U.S. Application Data

[63] Continuation of application No. 08/757,140, Dec. 3, 1996, Pat. No. 5,779,103, which is a continuation of application No. 08/377,842, Jan. 25, 1995, Pat. No. 5,664,701.

[51] Int. Cl.[6] ..... B67D 5/62

[52] U.S. Cl. ..... 222/146.5; 219/227; 219/421; 222/190; 222/325; 392/480

[58] Field of Search ..... 222/146.5, 190, 222/325, 227; 219/421; 392/480

[56] References Cited

U.S. PATENT DOCUMENTS

| | | | |
|---|---|---|---|
| D. 315,283 | 3/1991 | De Carolis et al. | D8/71 |
| 3,228,566 | 1/1966 | Knox, Jr. | 222/146 |
| 3,430,816 | 3/1969 | Nadherny et al. | 222/146 |
| 3,519,792 | 7/1970 | Solomon | 219/222 |
| 4,692,587 | 9/1987 | Spirk, Jr. et al. | 219/242 |
| 4,826,049 | 5/1989 | Speer | 222/146.5 |
| 4,998,698 | 3/1991 | Martinson | 248/176 |
| 5,048,742 | 9/1991 | Fortune | 228/20 |
| 5,769,272 | 6/1998 | Massena | 222/1 |
| 5,779,103 | 7/1998 | Massena | 222/146.5 |

*Primary Examiner*—Joseph A. Kaufman
*Attorney, Agent, or Firm*—Gregory M. Howison; Mark W. Handley

[57] ABSTRACT

A warming tray and removable heating cartridges of a glue gun system are provided. The warming tray has a base and a heating stand mounted to the base for holding the cartridges. The warming tray includes leads for connecting the cartridges to a source of electricity for heating the cartridges to operating temperatures. The glue gun system includes a gun having a barrel. A cartridge can be removably placed in the barrel. The cartridge has an open central passage to accept a glue stick and a tip to dispense the glue. Once received into the barrel the cartridge is heated, melting the glue therein. Additional cartridges can be placed in the warming tray such that they are electrically connected to a power supply and heated to a heated state. Thus, after one glue stick is used, a second can be immediately installed and used. An insulated tab allows for the easy handling of the cartridges.

15 Claims, 3 Drawing Sheets

GLUE GUN SYSTEM WITH REMOVABLE CARTRIDGES

CROSS-REFERENCE TO RELATED APPLICATION

The present application is a continuation of U.S. patent application Ser. No. 08/757,140, filed Dec. 3, 1996, now U.S. Pat. No. 5,779,013 entitled "Glue Gun System with Removable Cartridges" and invented by Len Massena; which is a Continuation of U.S. Pat. application No. 08/377,842, now U.S. Pat. No. 5,664,701, filed Jan. 25, 1995, entitled "Glue Gun System With Removable Cartridges" and invented by Len Massena; and is related to U.S. patent application Ser. No. 08/723,190, filed Sep. 27, 1996 now U.S. Pat. No. 5,769,272 and entitled "Removable Cartridges for a Glue Gun System," invented by Len Massena.

TECHNICAL FIELD OF THE INVENTION

The present invention relates to a multi-purpose glue gun system having removable cartridges and a heated stand. Specifically, the system allows the glue gun to accept different sizes and colors of glue sticks without spoiling the interior chamber of the gun with remnants of glue from an earlier use. Moreover, the system allows the cartridges to be held in a heating stand so each is ready for immediate use.

BACKGROUND OF THE INVENTION

Glue guns are used in the manufacture of textile products. A glue gun typically accepts a solid glue insert and melts one end of the insert. The melted glue can be controllably discharged from one end of the glue gun through a tip. The glue gun also has a handle to facilitate its handling by an operator. While glue is typically clear, certain textiles are manufactured using colored glues. This poses a problem when switching between different glue sticks. For example, if the user has applied a blue colored glue and then wants to switch to a yellow glue, the residual of blue glue left in the glue gun will initially spoil the color of the yellow glue exiting the tip. One solution to these problem is to have several glue guns, one devoted to each color glue to be dispensed. A second solution involves dispensing the second color of glue onto a waste sheet until the residual first glue has passed. Both solutions are wasteful, expensive and inadequate.

Standard glue guns demonstrate several other problems. For instance, a significant delay occurs after a second glue stick is inserted until it melts. Also, glue guns are typically structured to only accept one diameter of glue stick. Glue sticks can come in various diameters and lengths. Also, the tips of the glue gun are rarely more than an orifice through which the glue flows. If the user wants to share the glue or press it into a seem, the tip is invariably fouled. Another problem with existing glue guns relates to the heating units. Once a heating unit burns out the gun is inoperative.

A need exists for a glue gun which can accept variably sized glue sticks including extra long sticks. Such a glue gun should also be able to accept glue sticks of various colors without the risk of residual glue spoiling the next color. Further, a need exists for a glue gun with a tip designed to manipulate the glue after it has been dispensed. Also, a need exists for a glue gun which has an interchangeable heating element. When one heating element burns out, another can be inserted. Last, a need exists for a way of keeping the soon to be used glue sticks in a state virtually ready for use, thus minimizing any down time while the glue stick is heated.

SUMMARY OF THE INVENTION

The invention is directed toward a warming tray and removable heating cartridges of a glue gun system. The warming tray has a base and a stand mounted to the base for holding the removable cartridges. The warming tray includes leads for connecting the removable cartridges to a source of electricity for heating the cartridges to operating temperatures. The present glue gun system is a flexible system capable of handling glue sticks of various colors, diameters and lengths. The glue gun system includes a gun having a barrel. One of the removable cartridges can be removably placed in the barrel. The cartridge has an open central passage to accept a glue stick and a tip to dispense the glue. Once received into the barrel the cartridge is heated, melting the glue therein. Additional cartridges can be maintained in a heated state by a heating stand. Thus, after one glue stick cartridge is used, a second can be immediately installed and used. An insulated tab allows for the easy handling of the cartridges. The cartridges can be sized to accept smaller diameter glue sticks. Likewise, a standard cartridge can be downsized with an insertable adapter. An extended length holder can also be attached to the gun to feed an extended length of glue stick. The ability to replace cartridges allows the glue gun to accept glue sticks of various colors without the risk of residual glue spoiling the color of the next glue stick.

The cartridges can have specialized tips designed to manipulate the glue after it has been dispensed. The heating elements can be placed in either the cartridges or the gun itself. In the former case, the cartridges act as an interchangeable heating element. When the heating element of one cartridge burns out, another cartridge having a functional heating element can be inserted into the barrel of the glue gun.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE DRAWINGS

Figure 1:
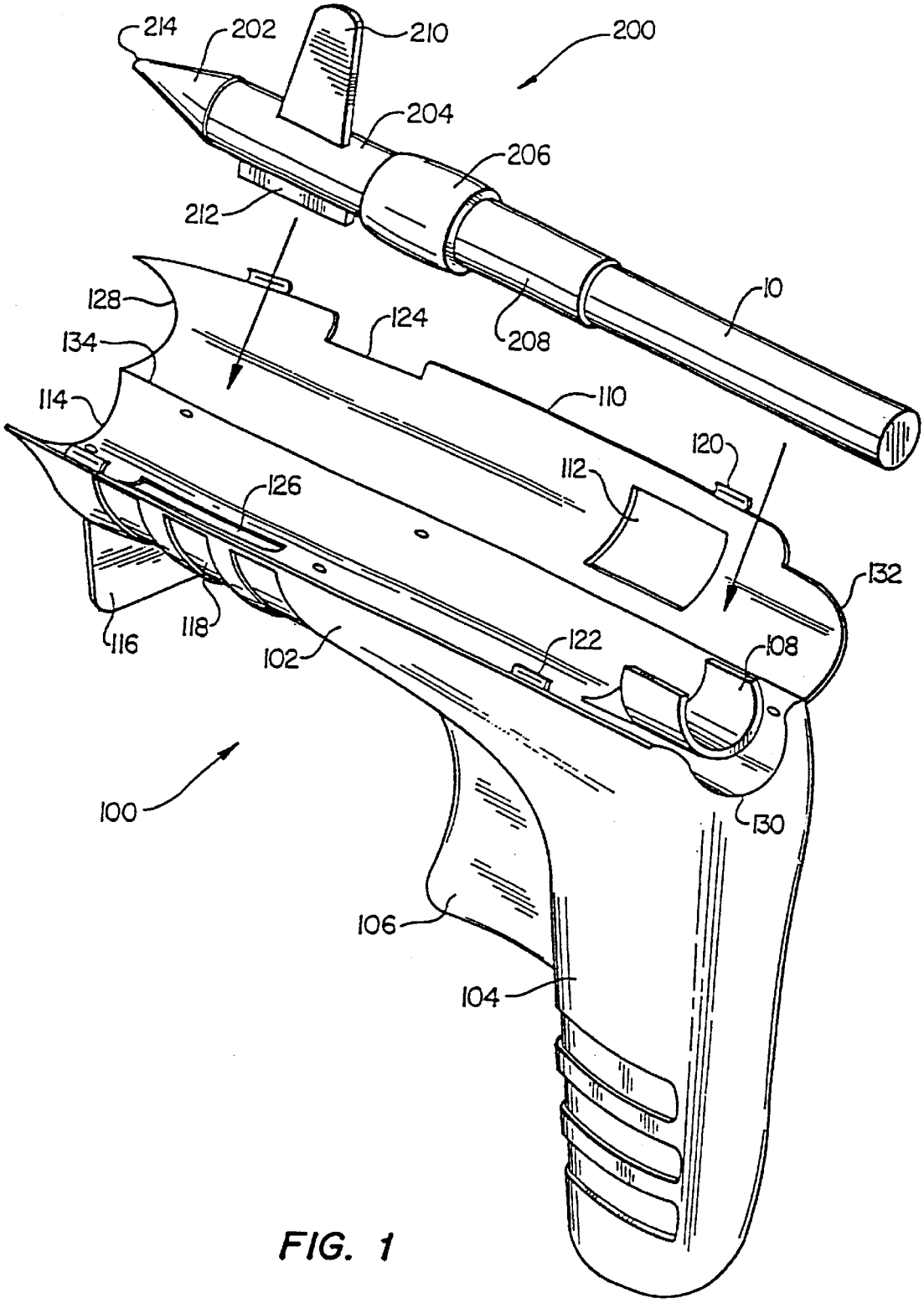
FIG. 1 is a perspective view of a glue gun embodying the present invention accepting a glue stick in a cartridge.

The present glue gun system overcomes many of the disadvantages found in the prior art. Referring to FIG. 1, a glue gun 100 is illustrated which embodies the present invention. The gun 100 has a barrel 102 connected to a handle 104. A trigger 106 is pivotally attached to the handle 104 such that compression of the trigger 106 advances a gripper 108. A stand 116 on the bottom surface of the barrel 102 allows the gun 100 to rest in a stable position. The barrel 102 is generally hollow and accessible by opening an upper lid 110. The lid 104 pivots along hinge 134. Once closed, the lid 110 is secured by placing the clasp 120 over the lip 122. The barrel 102 has a front opening defined by surfaces 114 and 128. Likewise, the barrel 102 has a rear opening defined by surfaces 130 and 132.

A cartridge 200 can be received into the opened barrel 102. The cartridge has a tip 202 with a front orifice 214. The tip 202 of the cartridge 200 extends beyond the surfaces 114 and 128. The cartridge 200 also comprises a generally cylindrical hollow body 204 with an enlarged diameter portion 206. The enlarged diameter portion 206 can closely match the inner diameter of the barrel 102. A conductor 212 attached to the cartridge body 204 is inserted into slot 126 within the barrel 102. The conductor 212 can serve two functions. In one embodiment, a heating element 118 is contained within the barrel 102. Heat is generated by a resistive heating element 118 as is well known in the art. In this the first embodiment, heat from the heating element 118 is conducted to the cartridge 200 by conductor 212. In a second embodiment, an electrical connection is provided in the barrel 102 in place of the heating element 118. In the second embodiment, the resistive heating element 118 is contained within the cartridge 200. When the conductor 212 is inserted into the slot 126, current is provided to the cartridge 200 allowing it to heat. In either embodiment, an insulated tab 210 is provided for the user to grasp when withdrawing the cartridge 200 from the barrel 102.

The cartridge 200 also contains a sleeve 208. A glue stick 10 is inserted into the sleeve 208 and advanced into the cartridge body 204 where it is rendered into a viscous fluid state by heating. The stick 10 is advanced into the sleeve 208 by gripper 108 when the trigger 106 is compressed. Advancing the glue stick 10 into the sleeve 208 forces the melted glue in the cartridge body 204 to exit through the tip 202 and orifice 214. The gripper 108 can advance the glue stick 10 to the sleeve 208. Once the end of the glue stick 10 has entered the sleeve 208, another glue stick must be loaded.

If the second glue stick is a different color than the first, a second cartridge can be used. The first cartridge 200 prevented any melted glue from spoiling the inside of the barrel 102. Therefore, a second cartridge containing a second glue stick can be easily inserted into the clean interior of the barrel. The second cartridge will perform in the same fashion as the first. Likewise, the second glue stick will be advanced in the same fashion.

Figure 2:
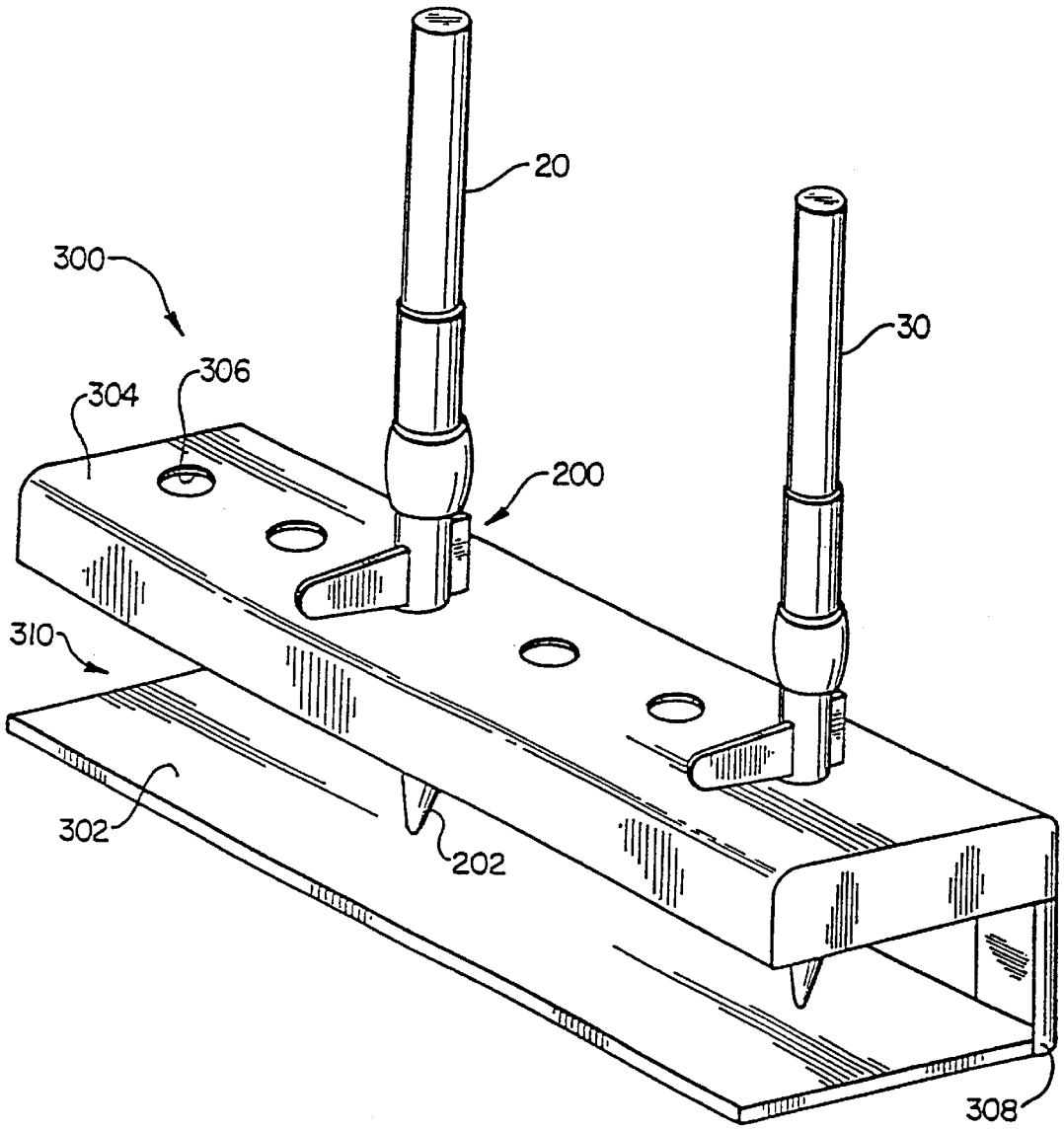
FIG. 2 is a perspective view of a first heating stand to accept unused cartridges, thereby keeping them heated for use.

Additional cartridges with glue sticks 20 and 30 can be kept in a heating stand 300, shown in FIG. 2. The stand has a base 302 and a heating portion 304 connected by posts 308. The heating portion 304 can be spaced from the base 302 by a gap 310. The heating portion 304 has a plurality of openings 306 for accepting the cartridges. Once inserted the cartridges are heated, keeping the glue in the cartridge body 204 in a liquid state. The glue tends not to drip from the tip because the glue stick is not advanced into the cartridge. However, for certain applications, a work piece can be placed in the gap 310. If a glue stick 20 is pushed into the cartridge 200, glue will exit tip onto the work piece. As described earlier, the resistive heating element can be within the heated portion 304 and the heat conducted to the cartridge. Alternatively, a heating element can be placed within the cartridge 200. In this embodiment, current is conducted into the cartridge by the leads within the opening 306. In either case, the cartridge 200 and glue is kept in a heated state to minimize any down time experienced when switching between glue sticks.

Figure 3:
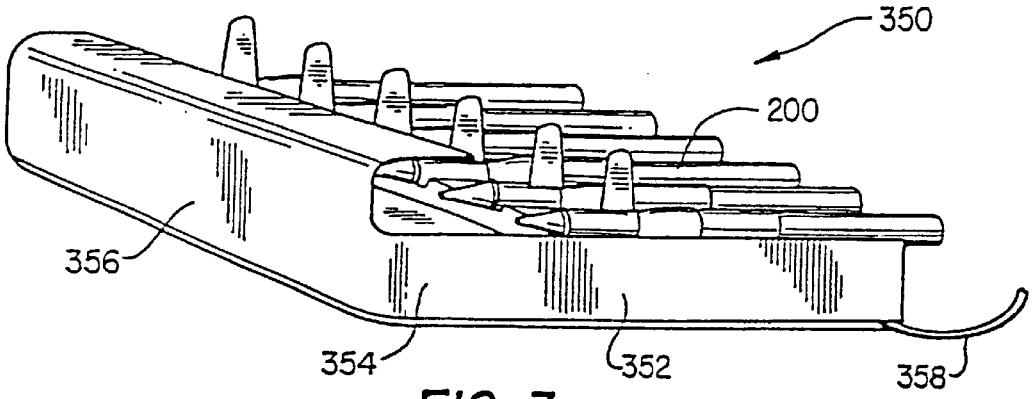
FIG. 3 is a perspective view of a second heating stand.

FIG. 3 illustrates a second style of heating stand 350. The stand 350 has a base 352 which sets on a surface. A tray 354 has a plurality of grooves for accepting cartridges such as cartridge 200. Once set in the grooves, the cartridges are heated by a heating element in the base 352. Alternatively, the heating elements can be placed in the cartridge. In this case, a cartridge engages leads in the grooves which connect the heating element in the cartridge to a source of electricity. In either case, electricity can be supplied to the unit by cord 358. Energy can be supplied by any appropriate source. A heat shield 356 protects the user from the heated cartridges.

Figure 4A:
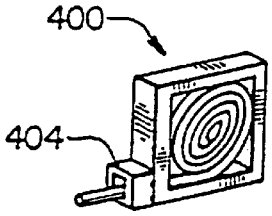
FIG. 4 is an extended length glue stick cartridge which contains a spiral wrapped length of glue and an adapter.
Figure 4B:
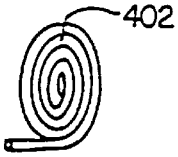
Figure 4C:
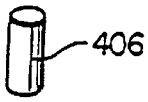

The glue gun system can also accept an extended length glue stick cartridge 400, shown in FIG. 4. Most glue sticks are a relatively short, six to eight inches in length. The cartridge 400 can hold a spiral of solid, yet flexible, glue 402 of lengths around six feet. The glue stick 402 can be provided with a suitable cross section to allow it to more easily be stored in a spiral. A forward tab 404 of the cartridge 400 is accepted between rear surfaces 130 and 132. The glue stick 402 is advanced by grippers 108. The system can also be modified to accept smaller diameter sticks using adapter 406. The adapter 406 can have a reduced diameter central passage for accepting the smaller diameter glue sticks.

Figure 5A:
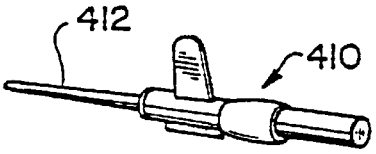
FIGS. 5*a* to 5*d* illustrate various cartridges having specialized tips.
Figure 5B:
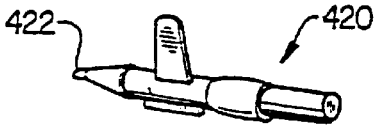
Figure 5C:
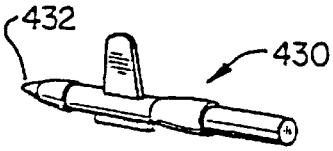
Figure 5D:
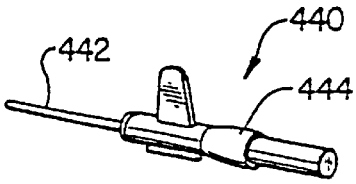

The glue gun system also allows for a number of cartridges having specialized tips. FIG. 5*a* illustrates a cartridge 410 having an extended narrow tip 412 which can dispense glue in hard to reach places. FIG. 5*b* illustrates a cartridge 420 having a flattened tip 422, thereby allowing the user to flatten the glue from a thin bead into a flat bed. FIG. 5*c* illustrates a cartridge 430 illustrates a glue gun cartridge 430 suitable for use with a stick of caulk, rather than glue. Caulk sticks perform in the same way as glue sticks, but require a bigger orifice 432 to properly flow. FIG. 5*d* illustrates a specialized cartridge that allows the glue gun system to double as a soldering gun. The soldering tip cartridge 440 has an extended tip 442, but no internal passage to accept a glue stick. The cartridge body 444 simply accepts heat from the heating element and transmits that to the tip 442. With any of the cartridges described above, the heating element can be resident in the cartridge or in the barrel.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

I claim:

1. An apparatus for use in dispensing hot melt glue with a glue gun system having a handle and a plurality of removable heating cartridges which are removably attached to the handle, the cartridges each including an electric heating element which heats the hot melt glue for dispensing from within a respective one of the cartridges and a cartridge interface member which electrically connects the electric heating element to an electric power source, the apparatus comprising:

a base;

a stand mounted to said base, said stand having a plurality of mating engagement sections, each of said engagement sections configured for receiving one of the cartridges and retaining the cartridges in a fixed relation relative to said stand;

a plurality of stand electric members mounted to said stand in respective ones of said mating engagement sections, such that the cartridge interface members releasibly engage with one of said electric interface members which corresponds to one of said mating engagement sections within which a respective one of the cartridges is placed to electrically connect said stand to the respective one of the cartridges; and wherein removal of the respective one of the cartridges removes a respective one of the cartridge interface members from engaging said corresponding one of said electric members to electrically disconnect the respective one of the cartridges from said stand.

2. The apparatus of claim 1, further comprising the cartridges, said cartridges having said electric heating elements and said cartridge interface members.

3. The apparatus of claim 1, wherein said stand comprises a heating portion mounted to and spaced apart from said base, and said mating engagement sections comprise a plurality of openings for receiving the cartridges.

4. The apparatus of claim 3, wherein said electric members comprise leads which are disposed within said openings, such that the cartridges will engage said leads when placed within said openings in said heating portion to electrically connect the resistive heating elements within the cartridges to a power cord to supply electricity and maintain the cartridges at a heated state.

5. The apparatus of claim 4, further comprising the cartridges, said cartridges having said electric heating elements and said cartridge interface members.

6. The apparatus of claim 1, wherein said stand comprises a tray mounted to said base, said tray having a plurality of grooves for accepting the cartridges, wherein one of the cartridges fits within each of said grooves.

7. The apparatus of claim 6, wherein said electric members comprise leads which are mounted to said tray and disposed in said grooves, such that the cartridges will engage said leads when placed within said grooves to electrically connect the resistive heating elements within the cartridges to a power cord to supply electricity and maintain the cartridges at a heated state.

8. The apparatus of claim 7, further comprising the cartridges, said cartridges having said electric heating elements and said cartridge interface members.

9. An apparatus for use in dispensing hot melt glue with a glue gun system having a handle and a plurality of removable heating cartridges which are removably attached to the handle, the cartridges each including an electric heating element which heats the hot melt glue for dispensing from within a respective one of the cartridges and a cartridge interface member which electrically connects the electric heating element to an electric power source, the apparatus comprising:

a base;

a heating portion mounted to and spaced apart from said base, said heating portion having a plurality of openings for receiving the cartridges; and leads mounted to said heating portion, such that the cartridge interface members of respective ones of the cartridges will engage said leads when placed within said openings in said heating portion to electrically connect the resistive heating elements within the respective ones of the cartridges to a power cord to supply electricity and maintain the cartridges at a heated state.

10. The apparatus of claim 9, wherein said heating portion is mounted to and spaced apart from said base by at least one post.

11. The apparatus of claim 9, wherein said leads are mounted in said openings.

12. The apparatus of claim 9, further comprising the cartridges.

13. An apparatus for use in dispensing hot melt glue with a glue gun system having a handle and a plurality of removable heating cartridges which are removably attached to the handle, the cartridges each including an electric heating element which heats the hot melt glue for dispensing from within a respective one of the cartridges and a cartridge interface member which electrically connects the electric heating element to an electric power source, the apparatus comprising:

a base;

a tray mounted to said base, said tray having a plurality of grooves for accepting the cartridges, one of the cartridges fitting within each of said grooves; and leads mounted to said tray, such that the cartridge interface members of respective ones of the cartridges will engage said leads when placed within said grooves to electrically connect the resistive heating elements within the respective ones of the cartridges to a power cord to supply electricity and maintain the cartridges at a heated state.

14. The apparatus of claim 13, wherein said leads are disposed in said grooves.

15. The apparatus of claim 14, further comprising the cartridges.

* * * * *